United States Patent [19]

George et al.

[11] Patent Number: 4,909,147

[45] Date of Patent: Mar. 20, 1990

[54] METHOD FOR DIRECT CHARGING OF THE SURFACE OF AN IMPRESSION ROLL OF AN ELECTROSTATIC ASSIST GRAVURE PRESS

[75] Inventors: Harvey F. George, West Hempstead; Robert H. Oppenheimer, Glen Cove, both of N.Y.

[73] Assignee: Gravure Association of America, New York, N.Y.

[21] Appl. No.: 653,701

[22] PCT Filed: Feb. 7, 1983

[86] PCT No.: PCT/US83/00164

§ 371 Date: Sep. 24, 1984

§ 102(e) Date: Sep. 24, 1984

[87] PCT Pub. No.: WO84/03068

PCT Pub. Date: Aug. 16, 1984

[51] Int. Cl.[4] ..... B41F 9/00

[52] U.S. Cl. ..... 101/170; 101/153; 101/489

[58] Field of Search ..... 101/152, 153, 216, 132, 101/136, 170, DIG. 13, 138, 139, 141-143, 151, 154, 155-157, 170, 219, 426, 489, 174, 178, 181, 183; 310/248, 251, 252, 240, 244, 232; 346/153, 155; 250/324; 355/3 CH

[56] References Cited

U.S. PATENT DOCUMENTS

| | | | |
|---|---|---|---|
| 904,801 | 11/1908 | Noeggerath | 310/244 |
| 2,558,900 | 7/1951 | Hooper | 101/426 X |
| 2,654,315 | 10/1953 | Huebner | 101/211 |
| 2,691,343 | 10/1954 | Huebner | 101/426 |
| 3,619,720 | 11/1971 | Coberly | 101/153 |
| 3,653,065 | 3/1972 | Brown, Jr. | 101/DIG. 13 |
| 3,705,996 | 12/1972 | Ahmed | 310/232 |
| 4,208,965 | 6/1980 | Eichler | 101/426 |

FOREIGN PATENT DOCUMENTS

| | | |
|---|---|---|
| 1159923 | 7/1969 | United Kingdom . |
| 1548098 | 7/1979 | United Kingdom . |

*Primary Examiner*—J. Reed Fisher

*Attorney, Agent, or Firm*—Parmelee, Bollinger & Bramblett

[57] ABSTRACT

A method and associated apparatus for applying a charge directly to an impression roll (12) which engages a gravure cylinder (14) of an electrostatic assist gravure press, wherein the improvement comprises the steps of placing a plurality of spaced contacts (26 or 54) capable of applying a charge to the impression roll (12) in direct contact with the surface of the impression roll (12), arranging the spacing between the contacts (26 or 54) and the width thereof so that predetermined groupings of the contacts (26 or 54) correspond to approximately the various web widths to be used with the gravure press, and controlling the charge applied by the contacts (26 or 54) to the surface of the immpression roll (12) to minimize the current leakage between the impression roll (12) and the gravure cylinder (14) in those areas of the impression roll (12) where the impression roll (12) directly engages the gravure cylinder (14) without the interposition of a web (22) therebetween.

6 Claims, 3 Drawing Sheets

METHOD FOR DIRECT CHARGING OF THE SURFACE OF AN IMPRESSION ROLL OF AN ELECTROSTATIC ASSIST GRAVURE PRESS

BACKGROUND OF THE INVENTION

The present invention relates to electrostatic assist gravure printing, and more specifically to an improved method and apparatus for applying a charge directly to the impression roll of a gravure press.

The basic electrostatic assist system for a gravure press is disclose in British Patent No. 1,159,923 published July 30, 1969, to Gravure Research Institute, Inc., entitled METHOD AND APPARATUS FOR TRANSFERRING INK IN GRAVURE PRINTING, the disclosure of which is incorporated herein by reference, and corresponding copending U.S. patent application Ser. No. 183,401 filed on Sept. 2, 1980, now U.S. Pat. No. 4,697,514, in the names of Harvey F. George and Robert H. Oppenheimer entitled, METHOD AND APPARATUS FOR TRANSFERRING INK IN GRAVURE PRINTING. The aforementioned British patent and the corresponding United States patent application disclose a semiconducting impression roll in which an electric charge is applied directly to the impression roll to create an electric field across the web at the nip between the gravure cylinder and the impression roll to cause the ink present in the gravure cells at the nip to more readily transfer to the web during printing, thereby minimizing the "skipped dots" problem. Further, it is disclosed in the aforementioned British patent and the corresponding United States patent application, that the charge can be applied directly to the inner metal core of the impression roll by a brush, indirectly via a corona wire spaced from the impression roll, or through a series of wire contacts in direct contact with an impression roll having a particular construction to provide a capacitive charging effect.

Various other charging arrangements based on those disclosed in the aforementioned British patent and United States patent application have also been used in electrostatic assist gravure printing for direct and indirect charging. Specifically, one such system for indirect charging uses a corona charging bar with ability to apply the charge over selected portions of the web to allow for changes in web width. See for example, British Patent No. 1,548,098 issued to Walter Spengler on July 4, 1979. However, such systems generally provide too little current and require very high voltage levels. Thus, they are more susceptible to press fires. Another system for indirect charging is disclosed in U.S. Pat. No. 4,208,965 issued to Eichler et al. on June 24, 1980, applies a corona charge through a plurality of decoupled electrodes to reduce the short circuit current to a value less than the critical breakdown current for the environment.

Another direct charging system uses a conductive roll which engages the impression roll to provide the direct application of charge thereto. Such a direct charging system suffers from the deficiency that the conductive roll must be quite large on a wide publication press, e.g., 9 inches or so in diameter, to avoid excessive deflection, and it is difficult to install, particularly on wide presses.

With indirect charging systems employing a corona producing means a high voltage of approximately 15,000 volts is needed to produce ions and electrons and drive them from the corona producing device to the impression roll. The corona current is about 400 microamperes per press unit maximum. However, with direct charging systems only up to about 2000 volts maximum is needed for paper and the systems presently used permit currents up to about 3 milliamperes before tripping. Further, the trip value can be set lower, as desired.

With the present direct charging arrangements, webs significantly narrower than the width of the impression roll create a number of problems. The current loss during charge application in non-web areas is significant and there is a gradual charge loss near the edges of the web thereby reducing the effectiveness of the electrostatic charging. One approach to solving this problem, is the undercutting of the impression roll to accommodate narrow webs. However, with deflection compensating impression rolls, such as the Bugel Roll manufactured by M.A.N. of Augsburg, West Germany; the CDR Controlled Deflection Roll manufactured by Motter Printing Press Co. of York, Pa.; the Flexible Impression Roller manufactured by Componenti Grafici of Lomellina, Italy; and the NIPCO Roller manufactured by Escher Wyss Ltd. of Zurich, Switzerland, undercutting of the impression roll to accommodate narrow webs is not a viable option. The NIPCO roller alleviates this problem somewhat by allowing pressure to be selectively applied over the area of the web with minimal pressure being applied to areas where the impression roll covering contacts the gravure cylinder directly. The remaining deflection compensating impression systems provide uniform impression pressure across the face width of the impression roll covering. However, all such deflection compensating impression systems result in significant current leakage during charge application.

SUMMARY OF THE INVENTION

It is an object of the present invention to provide an improved direct charging electrostatic assist system for a gravure press in which the current leakage can be minimized or eliminated in those areas where the impression roll is in direct contact with the gravure cylinder.

It is a further object of the present invention to provide an improved direct charging electrostatic assist system for a gravure press in which the extent of the charge application can be readily adjusted to accommodate webs of different widths.

It is a further object of the present invention to provide an improved direct charging electrostatic assist system for a gravure press in which the extent of the charge application can be readily adjusted to accommodate changes in web location.

It is a further object of the present invention to provide an improved direct charging electrostatic assist system for a gravure press which can accommodate a certain amount of misalignment and vibration.

It is a still further object of the present invention to provide an improved direct charging electrostatic assist system for a gravure press which is easy to install, particularly on wide presses.

It is a still further object of the present invention to provide an improved direct charging electrostatic assist system for a gravure press which may be used with deflection compensation impression rolls.

It is a still further object of the present invention to provide an improved direct charging electrostatic assist system for a gravure press which is economical and overcomes certain deficiencies of known electrostatic assist charging systems.

Briefly, in accordance with the present invention, a method and associated apparatus is disclosed for applying a charge directly to an impression roll which engages a gravure cylinder of an electrostatic assist press, wherein the improvement includes the steps of placing a plurality of spaced contact capable of applying a charge to the impression roll in direct contact with the surface of the impression roll, arranging the spacing between the contacts and the width thereof so that predetermined groupings of the contacts correspond to approximately the various web widths to be used with the gravure press, and controlling the charge applied by the contacts to the surface of the impression roll to minimize the current leakage between the impression roll and the gravure cylinder in those areas of the impression roll where the impression roll directly engages the gravure cylinder without the interposition of a web therebetween.

Other objects, aspects and advantages of the present invention will be apparent from the detailed description considered in conjunction with preferred embodiment of the invention illustrated in the drawings, as follows:

DETAILED DESCRIPTION

Figure 1:
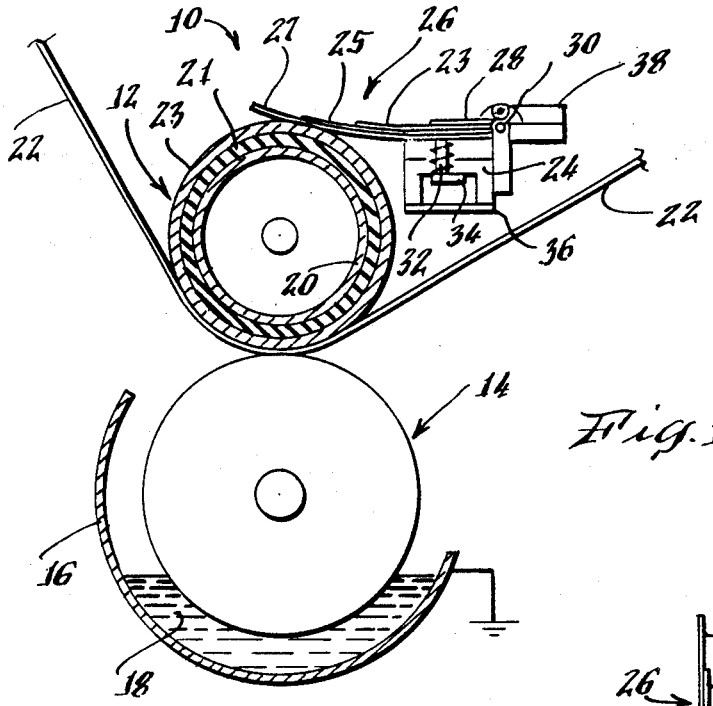
FIG. 1 is a side elevational view of an electrostatic assist gravure press including a direct charging system illustrating one embodiment of the present invention.

Referring to FIG. 1, one embodiment of a direct charging system in accordance with the present invention is illustrated generally at 10. An impression roll 12 is positioned adjacent a gravure cylinder 14 for contact therewith. An ink fountain 16 is arranged circumjacent the gravure cylinder 14 to supply ink 18 to the surface of the gravure cylinder 14 as the gravure cylinder 14 is rotated by conventional means through the ink fountain. A doctor blade (not shown) removes excess ink from the surface of the gravure cylinder 14. Preferably, the impression roll 12 includes a hollow metal core 20, an intermediate insulating rubber layer 21 and an outer semiconducting layer 23. The metal core 20 of the impression roll 12 is grounded. Preferably, the impression roll 12 has a maximum current leakage of 0.2 milliamperes at 4000 V. The impression roll 12, illustrated in FIGS. 1 through 5 includes two layers over the metal core 20. The first layer or intermediate insulation layer 21, is approximately 3–5 mm thick and covers the length of the core 20. The second layer or semiconducting layer 23 is only moderately conductive and is approximately 8–13 mm thick. The resistivity of the semiconducting layer is preferably about $2\times10^7$ ohm cm. However, it should be understood that the impression roll may have only one layer over the core 20 or include multiple semiconducting layers of varying conductivity as desired. Further details regarding electrostatic assist, including press and ink parameters, may be obtained from the "Electrostatic Assist Manual," published by Gravure Research Institute, Inc. of Port Washington, New York in 1981.

A web 22, transmitted between conventional delivery and take up rolls (not shown), is pressed between the impression roll 12 and the rotating gravure cylinder 14. The impression roll 12 is placed in pressure contact with the gravure cylinder 14 by conventional means. At the nip between the impression roll 12 and the rotating gravure cylinder 14 ink is transferred from the gravure cells of the gravure cylinder 14 to the web 22. The web 22 may be a full or partial web and may be located anywhere along the width of the impression roll 12, as desired.

The charge coupling system 10 includes a supporting cross member 24 that is either made of an insulating material, such as phenolic, or coated with such an insulating material in such a fashion as to prevent grounding of any electrically charged parts. Pivotally mounted on the supporting cross member 24 are a plurality of contact segments or wiper blades 26, see also FIG. 3, in which the wiper blades are separately designated as 26*a, b, c, d, e, f, g,* and *h*. The wiper blades 26 are affixed to an insulating holder 28, e.g., with screws; the holder 28 and blades 26 are pivotally mounted to supporting cross member 24 via pin 30. Preferably, the wiper blades 26 are deflectable and include three segments of varying lengths 23, 25 and 27 to provide an increased spring effect. Advantageously, the segments 23, 25 and 27 are stainless steel and are affixed to one another at one end e.g., by screws to form a leaf spring-like contact 26. The longest segment 27, is placed in contact with the surface of the impression roll 12. Advantageously, the segment 27 is pressed against the impression roll 12 with a slight amount of pressure by adjusting the position of the supporting cross member 24 relative to the impression roll 12 to maintain good contact with the surface of the impression roll 12 during rotation thereof. Thus, the wiper blade 26 is deflected slightly as seen in FIG. 1.

Spring loaded contacts 32 are arranged within the supporting cross member 24 and are biased toward engagement with their respective wiper blades 26 when the wiper blade 26 is in its operative position in contact with the supporting cross member 24, see FIG. 1. The other ends of the spring loaded contacts 32 are then electrically coupled to a charging circuit, see FIG. 6, via contacts 34.

Figure 2:
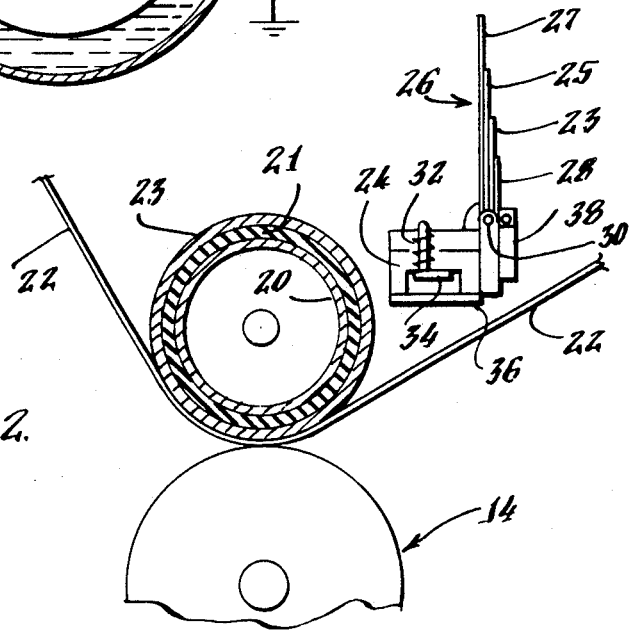
FIG. 2 is a side elevational view of a portion of FIG. 1 showing the contacts removed from engagement with the impression roll by rotation.

As seen in FIG. 2, the wiper blade 26 is illustrated in its pivot position, removed from contact with the impression roll 12 and its respective spring loaded contact 32, by being pivoted about pivot pin 30 to an inoperative position. Specifically,, the insulating holder 28 and the blade 26 are pivoted about pivot pin 30, e.g., by unlocking a detent 38. In this way, the individual wiper blades 26 can be lifted away from contact with the impression roll 12 in those areas where a web is not present, thereby reducing current leakage. Advantageously, the contacts 34 are housed within the supporting cross member 24 which includes a cover member 36 to enclose and isolate the contacts 34 from the ink vapors normally present in the nip area.

Figure 3:
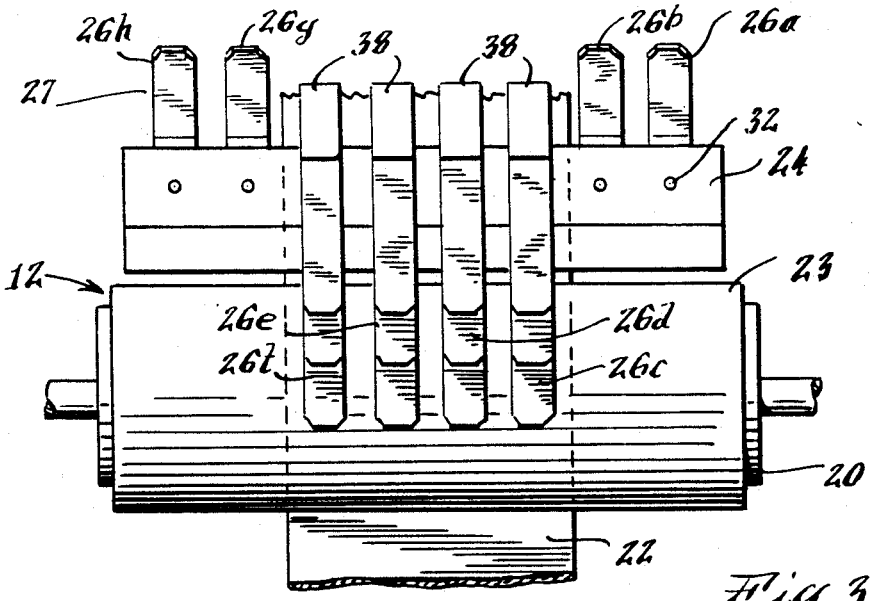
FIG. 3 is a top plan view of the direct charging system illustrated in FIG. 1.

FIG. 3 shows the spaced wiper blades 26*a–h*, as described in FIG. 1, positioned across the width of the impression roll 12. Preferably, the distance or gap between the wiper blades 26 is on the order of about ⅛ to about ¾ inch. Further, as seen in FIG. 3, the width of the web 22 is frequently substantially less than the width of the impression roll 12. Advantageously, the width and spacing of the wiper blades 26 corresponds mathematically to full and partial web widths so that wiper blades 26, which do not overlie the web and which extend beyond the width of the web 22 or partial web 22 being used, may be removed. That is, the wiper blades 26 to be used for charging the impression roll will correspond to approximately the web or partial web width present on the impression roll 12 and the wiper blades 26 which engage the surface of the impression roll 12 which directly contacts the gravure cylinder 14 are removed; see FIG. 3 showing wiper blades 26*a, b, g,* and *h* pivoted away from contact with the surface of the impression roll 12 while the grouping of wiper blades 26*c, d, e,* and *f* which correspond to approximately the web width used with the gravure press remain in contact with the surface of the impression roll 12.

Figure 4:
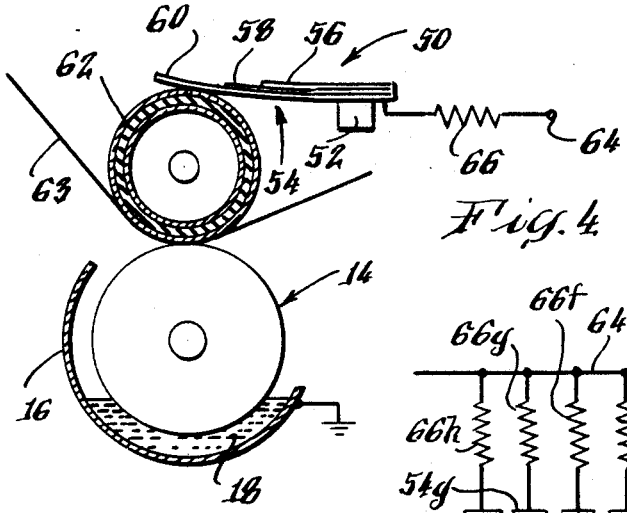
FIG. 4 is a side elevational view of an electrostatic assist gravure press including a direct charging system illustrating another embodiment of the present invention.

Referring to FIG. 4, an alternative embodiment of a direct charging system in accordance with the present invention is illustrated generally at 50. However, it should be understood that the embodiments in FIGS. 1–3 and FIGS. 4 and 5 may be combined in a single direct charging device, as desired. Such system 50 includes a support 52 which insulates wiper blade contacts 54 and associated electrical components from each other and from ground with the wiper blade contacts 54 affixed thereto, e.g., with screws. Preferably, the wiper blade contacts 54 include three segments of varying lengths 56, 58 and 60, similar to those described with reference to FIGS. 1–3. Advantageously, the segments 56, 58 and 60 are stainless steel and are affixed to one another e.g., by screws or welding, to form a leaf spring-like contact 54. The longest segment 60 is placed in contact with the surface of an impression roll 62 in the same manner as the contact 26 in FIG. 1 with pressure exerted on the impression roll 62 which results in good contact during rotation of the impression roll 62 and slight bending of the contacts 54 as seen in FIG. 4.

Figure 5:
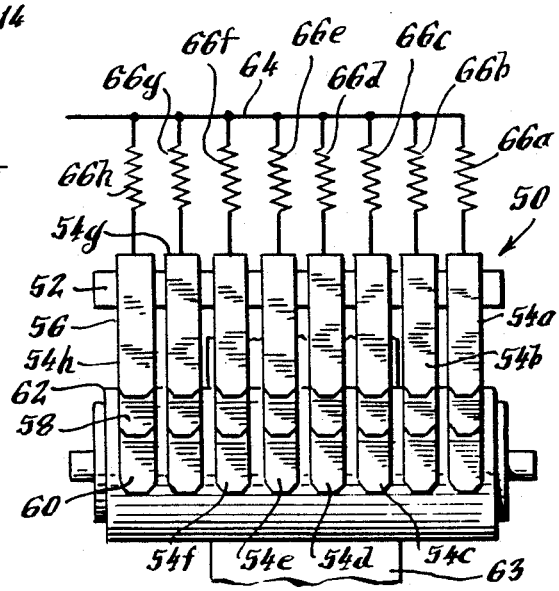
FIG. 5 is a top plan view of the direct charging system illustrated in FIG. 4.

Referring to FIG. 5, a plurality of spaced wiper blade contacts 54*a, b, c, d, e, f, g* and *h* are shown positioned across the width of the impression roll 62. A gap such as discussed with reference to FIG. 3 is maintained between the contacts 54*a–h*. Further, with this embodiment the contacts 54*a–h*, unlike the contacts 26*a–h*, are not removed from the impression roll 62 in those areas where the web 62 is absent. Instead, the contacts 54*a–h* are electrically coupled to a charging circuit, see FIG. 6, through a main bus 64 with high voltage resistors 66*a–h* placed in series with each of the contacts 54*a–h*, respectively. The resistors 66*a–h*, which preferably have a resistance on the order of about 10 to about 20 megohms, and a voltage rating of up to 6000 V, provide partial electrical decoupling of the contacts 54 which are left in place bearing directly against the impression roll 62. Moreover, such partial electrical decoupling further limits current peaks thereby adding an additional safety factor.

Further, as previously noted the embodiment of FIGS. 4 and 5 may be incorporated into the embodiment of FIGS. 1 through 3 by simply connecting the resistors 66*a–h* in series with the contacts 34 of the wiper blades 26 in FIGS. 1–3. Incorporating both of these embodiments in one direct charging device allows the wiper blade contacts to remain in contact with the impression roll during a short run and provides additional protection should the press operator forget to remove the wiper blade contacts which are in contact with those portions of the surface of the impression roll which are directly engaging the gravure cylinder without the interposition of a web therebetween.

Figure 6:
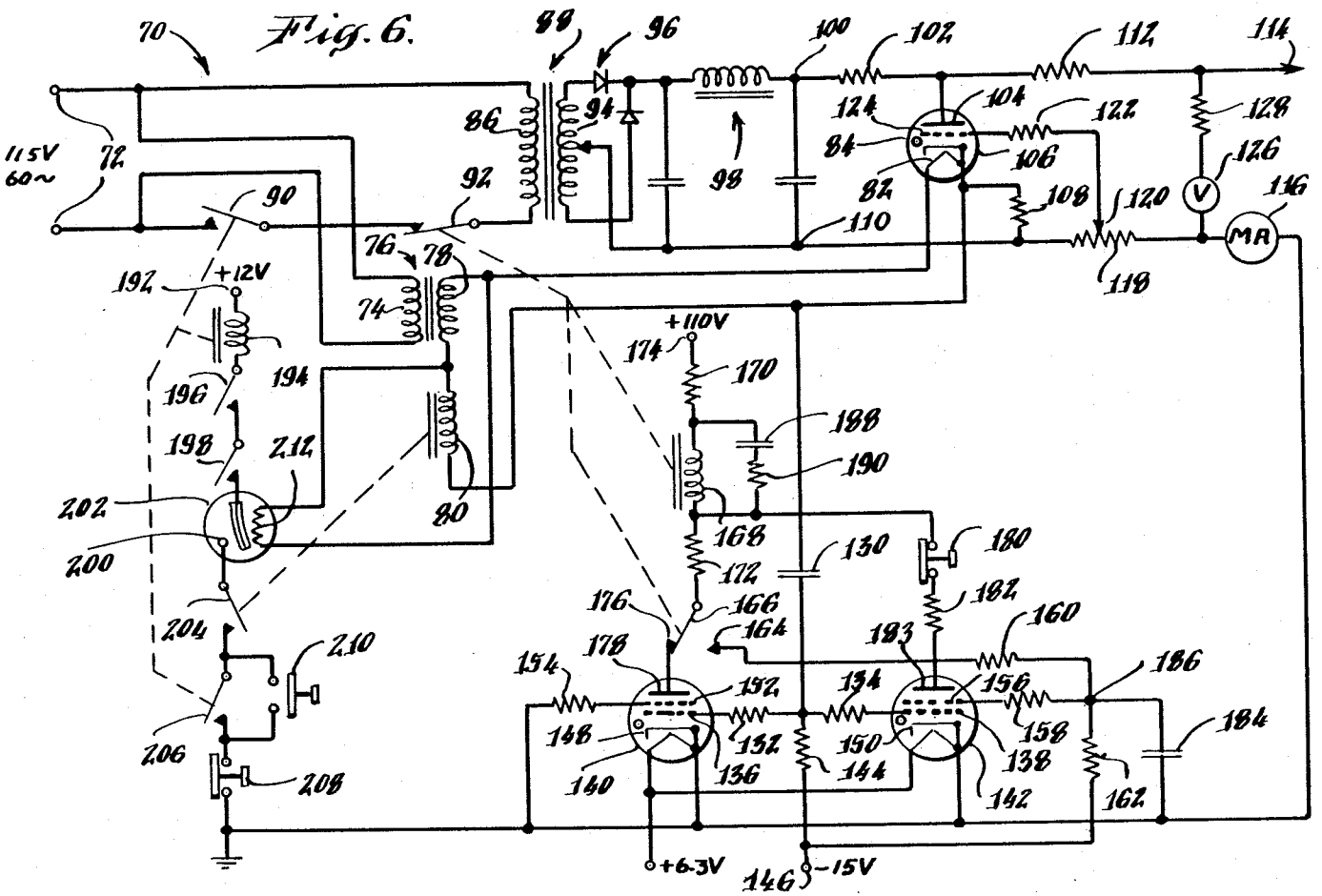
FIG. 6 is a schematic of one form of charging circuit for use with the direct charging systems illustrated in FIGS. 1 through 5.

Referring to FIG. 6, a charging circuit for use with the present invention is indicated generally at 70. However, it should be understood that other suitable charging circuits which provide overcurrent protection with a fast response time may also be used. With this circuit 70, which is also disclosed in the aforementioned British Patent, a pair of terminals 72 coupled to a 115 volt, 60 cycle source (not shown) is connected to the primary winding 74 of a filament transformer 76. Transformer 76 has a secondary winding 78 which is connected in series with a relay winding 80 to the filament 82 of a positive control grid Thyratron 84. Terminals 72 are also connected to the primary winding 86 of a power transformer 88. The connection to the primary winding 86 includes normally open relay contacts 90 and the normally closed relay contacts 92.

The transformer 88 is provided with a center tapped secondary winding 94 to which is connected a full wave rectifier circuit 96 and LC filter network 98. The positive output terminal 100 of the filter network 98 is connected through a plate resistor 102 to the anode 104 of the Thyratron 84. The cathode 106 of the Thyratron is connected through a cathode resistor 108 to the negative output terminal 110 of the filter network 98. A current limiting resistor 112 connects the plate 104 of the Thyratron 84 to an output terminal 114 which is connected to the buses shown in FIGS. 3 and 5.

As was previously mentioned, the gravure cylinder 14 is grounded. The circuit is completed by a connection from ground through a milliammeter 116 and a potentiometer 118 to the negative output terminal 110 of the filter network 98. The adjustable contact 120 of the potentiometer 118 is connected through a current limiting resistor 122 to the control grid 124 of the Thyratron 84. If desired, a voltmeter 126 may be connected in series with a scaling resistor 128 between the output terminal 114 and the junction between the milliammeter 116 and the potentiometer 118 as shown.

The cathode 106 of the Thyratron 84 is connected through a coupling capacitor 130 and current limiting resistors 132 and 134 to the control grids 136 and 138, respectively, of shield grid Thyratrons 140 and 142. The cut-off bias for the control grids 136 and 138 of the Thryratrons 140 and 142, respectively, is provided by connecting the junction between resistors 132 and 134 through a grid resistor 144 to a terminal 146 which is connected to a minus 15-volt source (not shown). The cathodes 148 and 150 of Thyratrons 140 and 142, respectively, are connected to ground. The shield grid 152 of Thyratron 140 is connected through a current limiting resistor 154 to ground. The shield grid 156 of Thyratron 142 is connected through a current limiting resistor 158 to a voltage divider network consisting of resistors 160 and 162 connected together. The other end of resistor 162 is connected to the minus 15-volt source at terminal 146. The other end of resistor 160 is connected to a fixed contact 164 associated with movable contact 166 which is under control of a relay winding 168. The relay winding 168 is connected in series with resistors 170 and 172 between a terminal 174 and the movable relay contact 166. Terminal 174 is connected to a positive 110 volt source (not shown).

Relay contact 166 normally engages a fixed contact 176 which is connected to the plate or anode 178 of Thyratron 140. The junction between the relay winding 168 and resistor 172 is connected through a normally closed manually operable switch 180 and a current limiting resistor 182 to the anode 183 of Thyratron 142. A capacitor 184 connects the common junction 186 of resistors 158, 160 and 162 to ground, as shown. A capacitor 188 and resistor 190 are connected in series across the winding 168.

A terminal 192 connected to a positive 12-volt supply (not shown) is connected in series with a relay winding 194 to a first interlock switch 196 and a second interlock switch 198. From interlock switch 198, the circuit continues in series fashion through the normally open contacts 200 of a thermal-control time delay switch 202, the normally open contacts 204 of relay 80, the normally open contacts 206 of relay 194 and the normally closed manually operable switch 208 to ground. Connected in shunt with the normally open contacts 206 is a normally open manually operable switch 210. The heating element 212 for the switch 202 is connected in parallel with the secondary winding 78 of the filament transformer 76.

The interlock switch 196 may be connected to the drive motor (not shown) for the press so that it may be closed only when the press is running at full production speed. This can be accomplished in any known manner.

Switch 198 is connected to the conventional pressure mechanism which positions the impression roll 12 against the gravure cylinder 14 so that it is closed only when impression pressure is applied to the gravure cylinder 14.

The contacts and switches illustrated in FIG. 6 are shown in the condition which prevails when the charging circuit 10 is fully deenergized. The voltages applied to terminals 72, 146, 174 and 192 are obtained from power supplies (not shown). These power supplies are turned on when it is desired to apply high voltage to the output terminal 114, through the bus to the wiper blade contacts 26 or 54 and hence to the impression roll 12. As soon as voltage appears at the terminals 72, filament current is supplied to the Thyratron 84. By separate power supply means (not shown) a filament voltage is also supplied in known manner to the Thyratrons 140 and 142. As soon as transformer 76 is energized it will supply voltage to the heating element 212 of thermal switch 202 and cause the relay 80 to operate. This will result in the closure of contacts 204 immediately, and at some later time closure of the thermal switch 202. Assuming that the gravure press is running at its operating speed, e.g., 2000 feet/minute, and that the impression roll 12 is in its operating or pressure applying position, the switches 196 and 198 are also closed. Thus, as soon as manually operable switch 210 is closed, a circuit will be completed through the relay winding 194. Completion of the circuit causes closure of relay contacts 90 and 206.

It will be seen that contacts 206 act as holding contacts for relay 194. Closure of contacts 90 will complete the circuit to the transformer 88, thereby applying a high voltage, e.g., up to approximately 2000 volts for paper, to the terminal 114. Assuming satisfactory operation of the gravure press with a web 22 between the gravure cylinder 14 and the impression roll 12, insufficient current will flow through the charging circuit 70 and specifically through potentiometer 118 to raise the voltage of the control grid 124 of Thyratron 84 to its ignition potential. To set the triggering current value, the slider 120 can be appropriately adjusted. It has been found that the maximum permissable current should be limited to about 3 milliamperes for presses designed for a maximum web width of about 100 inches.

If due to an imperfection in the web 22 or for some other reason, excessive current begins to flow between the impression roll 12 and the gravure cylinder 14, the Thyratron 84 will be triggered by the increased voltage drop across the potentiometer 118. This will immediately drop the voltage between terminal 114 and ground. In addition, the current now flowing through cathode resistor 108 will cause a positive going voltage pulse to be applied through capacitor 130 to the control grids 136 and 138 of Thyratrons 140 and 142. Thyratron 142 is maintained in its cut-off state by the negative bias on its shield grid 156. However, Thyratron 140 is triggered.

When Thyratron 140 conducts, it causes current to flow through relay winding 168. This results immediately in the interruption of the circuit to transformer 88 by opening contacts 92. In addition, contact 166 is moved from engagement with fixed contact 176 into engagement with fixed contact 164. Since the plate circuit to Thyratron 140 is interrupted, the Thyratron 140 is deenergized. However, current continues to flow through relay winding 168 and resistor 160 to place a positive charge on capacitor 184. The time constant of the capacitor 130 and resistor 144 is such that the positive pulse on control grid 138 decays before the voltage on the shield grid 156 of the Thyratron 142 exceeds the cutoff point. Thus, the Thyratron 142 remains deenergized. Energization of the winding 168 is prolonged by the capacitor 188 and resistor 190 connected in shunt thereto. This insures that sufficient charge is placed upon capacitor 184 to raise the voltage on the shield grid 156 of the Thyratron 142 above its cut-off point.

When contacts 92 are opened, thereby removing the input voltage to the transformer 88, the high voltage at the output terminal 114 is removed. Also as a consequence, the Thyratron 84 is extinquished. After a predetermined time delay, a restoration is attempted. The relay winding 168 becomes deenergized causing contact 166 to return to fixed contact 176, and contacts 92 to close. This restores the high voltage to output terminal 114. If a fault still exists, so that current is still flowing across the nip, the Thyratron 84 will fire again causing a positive going pulse to be supplied through capacitor 130 to the control grids 136 and 138 of Thyratrons 140 and 142, respectively. The charge on capacitor 184 will not have had sufficient time to decay through resistor 162 to drop below the cut-off level for the shield grid 156. Thus, both Thyratrons 140 and 142 will fire and relay winding 168 will be energized. When relay 168 is energized, a holding circuit is present through Thyratron 142. Consequently, the contacts 92 remain open and the high voltage at terminal 114 is not restored until the charging circuit 70 is reset manually by actuation of switch 180 to interrupt the plate voltage on Thyratron 122.

It is apparent, however, that if the fault was of brief duration such that it disappears before Thyratron 84 becomes triggered for the second time, the charging circuit 70 will resume its function without further interruption and the charge will be restored to the wiper blades 26 or 54. After a brief interval, the charge on capacitor 184 will decay through resistor 162 so as to restore the charging circuit 70 to its original standby condition. When it is desired to shutdown the charging circuit 70, switch 208 is actuated to release relay 194 and the power supplies are turned off.

It should be understood that the time delay switch 202 is provided to enable the filament 82 of Thyratron 84 to be brought up to operating temperature before the plate voltage is applied. The power supplies can be provided with a similar arrangement in known manner for protecting Thyratrons 140 and 142.

In operation, energization of the charging circuit 70 supplies a charge to the wiper blades 26 which are in direct contact with the surface of the impression roll 12. Those wiper blade contacts 26 which have been pivoted or flipped out of contact with the surface of the impression roll 12, see FIG. 2, do not receive a charge. However, if the embodiment in FIGS. 4 and 5 is used, all of the wiper blade contacts 54 receive a charge through decoupling resistors 66.

It should be understood that various modifications apparent to those skilled in the art may be made in the present invention without departing from the spirit and scope thereof, a described in the specification and defined in the appended claims.

What is claimed is:

1. A method for applying a charge directly to an impression roll which engages a gravure cylinder of an electrostatic assist gravure press, wherein the improvement comprises the steps of:

arranging a plurality of spaced contacts capable of applying a charge to the impression roll in direct contact with the surface of the impression roll;

partially electrically decoupling the contacts to minimize current leakage between the impression roll and the gravure cylinder in those areas of the impression roll where the impression roll directly engages the gravure cylinder without the interposition of a web therebetween; and applying a charge to the partially electrically decoupled contacts.

2. The method recited in claim 1, including the steps of:

arranging the spacing between the contacts and the width thereof so that predetermined groupings of the contacts correspond to approximately the various web widths to be used with the gravure press;

removing those contacts from contact with the surface of the impression roll in those areas of the surface of the impression roll where a web is absent.

3. The method recited in claim 2, including the step of:

deenergizing the removed contacts.

4. The method recited in claim 1, including the steps of:

forming the individual contacts from a plurality of deflectable conductive segments of varying lengths;

placing the deflectable conductive segments having the greatest lengths in pressure contact with the impression roll.

5. The method recited in claim 1, including the step of:

forming the contacts of stainless steel.

6. The method recited in claim 1, wherein:

the step of partially electrically decoupling is accomplished with resistors connected in series with the contacts.

* * * * *